US005568695A

United States Patent [19]

Kough

[11] Patent Number: 5,568,695

[45] Date of Patent: Oct. 29, 1996

[54] CUSTOM DECORATED CARDS

[76] Inventor: James W. Kough, 4280 E. Iowa Ave., Suite 310, Denver, Colo. 80222

[21] Appl. No.: 151,872

[22] Filed: Nov. 15, 1993

[51] Int. Cl.[6] ..... G09F 1/04

[52] U.S. Cl. ..... 40/124.1; 40/594

[58] Field of Search ..... 40/124.1, 594, 40/158.1, 638

[56] References Cited

U.S. PATENT DOCUMENTS

| | | | |
|---|---|---|---|
| 2,497,064 | 2/1950 | Baynes | 229/92.8 |
| 2,651,131 | 9/1953 | Long et al. | 40/124.1 X |
| 3,442,041 | 5/1969 | Morgan | 40/158.1 |
| 4,008,852 | 2/1977 | Davis | 229/92.3 |
| 4,200,222 | 4/1980 | Feuer | 40/158.1 X |
| 4,825,574 | 5/1989 | George | 40/158.1 |
| 4,930,234 | 6/1990 | Schmidt | 40/638 X |
| 4,953,780 | 9/1990 | Ross | 229/92.8 |
| 5,147,043 | 9/1992 | Gould | 40/124.1 X |

FOREIGN PATENT DOCUMENTS

| | | | |
|---|---|---|---|
| WO88/01419 | 2/1988 | WIPO | 40/124.1 |

*Primary Examiner*—Joanne Silbermann
*Attorney, Agent, or Firm*—Donald W. Margoli; John L. Isaac

[57] ABSTRACT

A card for use in coordination with an item, container, or wrapping paper with which an item or a container may be covered is provided and includes a body of sheet material having outer and inner side surfaces. A fold line forms first and second body sections adapted to be folded together about the fold lines. An adhesive layer is attached to the outer side surface, and a removable backing sheet covers the outer surface and adhesive layer. An incision is provided to divide the backing sheet into first and second portions. A decorative sheet, design-coordinated with the item, container, or wrapping paper with which an item or a container may be covered is sized to overlay the outer surface covered by the first portion of the backing sheet when the backing sheet first portion is removed therefrom. The adhesive layer secures the decorative sheet to the outer surface, and also serves to secure the outer surface covered by the second portion of the backing sheet to item, container, or wrapping paper with which an item or a container may be covered when the second portion is removed therefrom.

12 Claims, 2 Drawing Sheets

CUSTOM DECORATED CARDS

BACKGROUND OF THE INVENTION

1. Field of the Invention

The present invention relates generally to decorated cards and, more particularly, to cards, such as gift or greeting cards which can be customized for design coordination with any item, container, or wrapping paper. More specifically, the present invention relates to an improved decorative card, to methods of manufacturing such a card, and to kits for use in creating such cards.

2. Description of the Prior Art

The use of adhesive-backed labels or the like for a wide variety of purposes is well known in the art. Peel-off addressing labels are common. In addition, greeting cards and gift cards of various types are also well known in the art. A wide variety of attempts have been made in the past to either personalize such cards or to decorate them in a manner as to make them unique. Examples of such gift cards and post cards are set forth in U.S. Pat. Nos. 2,497,064; 4,008,852; 4,951,956 and 4,953,780, the teachings of which are incorporated by reference.

While the known aforementioned references illustrate personalized cards, packaging or post cards of various types, none have been utilized to allow the production of base member cards which can be color or design coordinated with every item, container, or with every wrapping paper with which an item or a container may be covered. Furthermore, none teach or provide kits for use in creating such cards.

SUMMARY OF THE INVENTION

Accordingly, it is one object of the present invention to provide a decorated base member card which can be design coordinated with every item, container, or wrapping paper with which an item or a container may be covered.

It is another object of the present invention to provide a method for producing a decorated base member card which can be design coordinated with every item, container, or wrapping paper with which an item or a container may be covered.

It is yet another object of the present invention to provide a kit for use in producing a decorated base member card which can be design coordinated with every item, container, wrapping paper with which an item or a container may be covered.

It is still yet another object of the present invention to provide a decorative card which can be design-coordinated with every item, container, or wrapping paper with which an item or a container may be covered.

It is another object of the present invention to provide a design-coordinated decorative card which, in its preferred embodiment, is serf adhesive to any item, container, or wrapping paper with which it is to be used.

Yet another object of the present invention is to provide a kit for creating a base member card which is adaptable for creating a design-coordinated card for attachment to an item, container, or wrapping paper with which an item or a container may be covered.

Yet another object of the present invention is to provide a kit for creating a base member card which is adaptable for creating a design coordinated card for attachment to an item, container, or wrapping paper with which an item or a container may be covered.

To achieve the forgoing and other objects and advantages, and in accordance with the preferred embodiments of the present invention as embodied and broadly described herein, a design coordinated card is provided for use in conjunction with, for example, package such as a gift covered by decorative wrap, although it may be used with any item, container, or wrapping paper with which an item or a container may be covered. The card includes a body or base member which has outer and inner side surfaces. It may include a fold line to form first and second body sections which are adapted to be folded together about such a fold line. As detailed below, adhesive or other adherent material is attached to the outer side surface. In preferred embodiments a removable backing sheet covers the adhesive on the outer surface. Such a removable backing sheet may include an incision which divides the backing sheet into first and second portions. A decorative sheet is coordinated with the item which the card is to accompany, or with its wrapping material, and is sized to overlay the outer surface covered by the first portion of the backing sheet when the first portion is removed therefrom. The adhesive on the outer surface secures the coordinated sheet to the first portion of the outer surface and is available to secure the second portion of the outer surface of the backing sheet to the package when the second portion is removed therefrom. The materials may be combined in a kit for use in the practice of the present invention.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings which are incorporated in and form a part of the specification, illustrate and explain complete preferred embodiments of the present invention, together with descriptions according to the best modes presently devised for the practical application of the principles thereof, and in which.

DETAILED DESCRIPTION OF THE PREFERRED EMBODIMENTS

Figure 1:
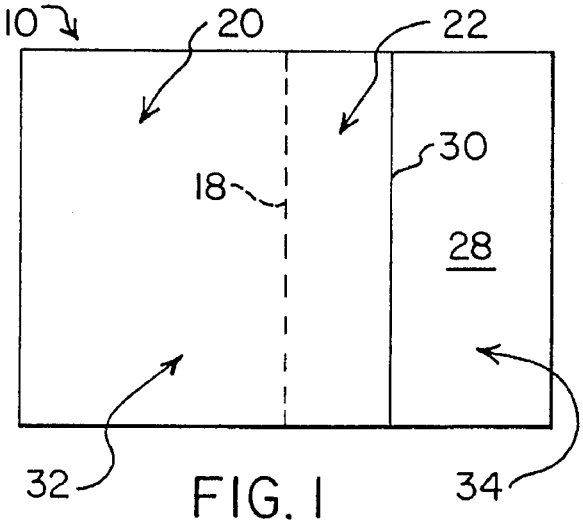
FIG. 1 is a plan view of the outer surface of a preferred embodiment of a design coordinated card constructed in accordance with the present invention.
Figure 3:
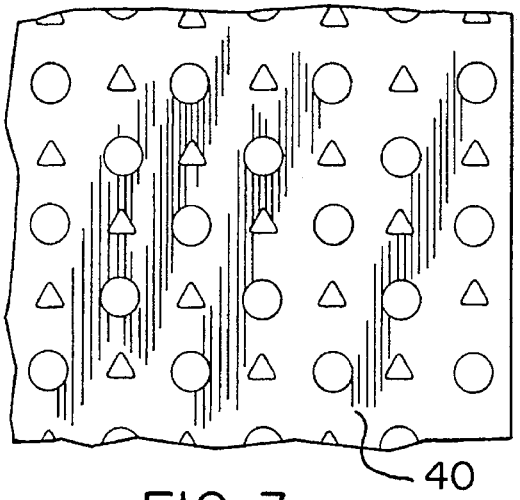
FIG. 3 is plan view of a representative piece of decorative wrap for use in production of a design coordinated card in accordance with the present invention.
Figure 2:
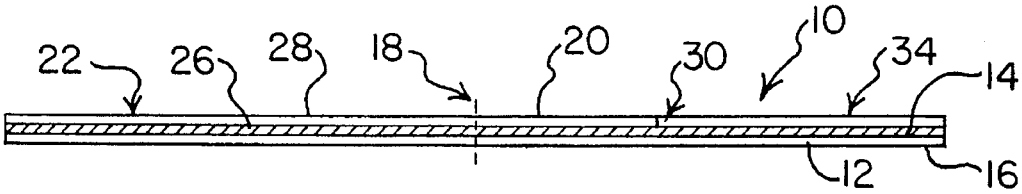
FIG. 2 is an enlarged and exaggerated, side view of the design coordinated card illustrated in FIG. 1.
Figure 7:
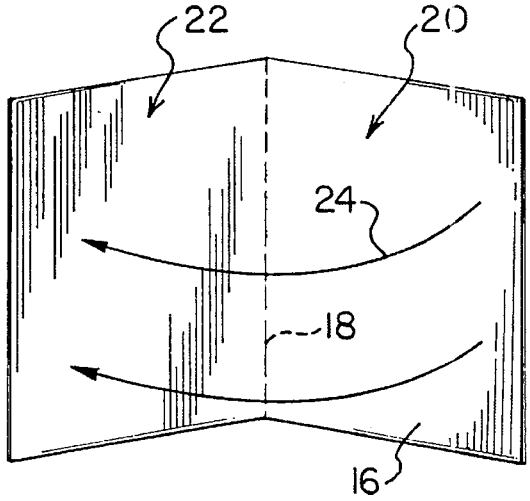
FIG. 7 is a perspective view of the inner surface of the card illustrated in FIG. 1 and illustrating the folding of the card along a fold line.

Like reference numbers refer to like parts in the various figures. Referring first to FIGS. 1 and 2, a design coordinated card, generally 10, is illustrated. Card 10 includes a sheet base member 12 having an outer side surface 14 and an inner side surface 16. Sheet base member 12 may be constructed from any desired type of sheet material such as paper of any weight, paper board, cardboard, plastic, or the like, although standard paper card stock of about 50 pound stock to about 120 pound stock, and having a degree of body stiffness is preferred. Sheet base member 12 does not include flaccid plastic or cloth, whether design coordinated or not, which is not a laminate which is constructed in accordance with the teaching of the present invention. In preferred embodiments the body of sheet base member 12 includes a fold or fold indication line 18 which allows body member 12 to be formed into a first and second sections 20 and 22. Fold line 18 is preferably medial to the body of sheet base member 12, to thereby divide sheet base member 12 into substantially equally sized and dimensioned halves. In preferred embodiments fold line 18 will be scored or creased for ease of location and folding, as illustrated in FIG. 7 by arrows 24. While sheet base member 12 is illustrated in the shape of a rectangle, any geometric or non-geometric shape, including squares, ovals, circles, triangles, rhomboids, free form and random shapes, and combinations thereof may be used in the practice of the present invention.

Referring to FIG. 2, in preferred embodiments an adhesive 26 is located on the outer surface 14 of the sheet base member 12. The adhesive 26 may be in the form of a continuous layer of adhesive material, or it may be discontinuous, say in the form of adhesive strips or dots distributed over outer surface 14. In preferred embodiments, and in kits made in accordance with the present invention, a backing sheet 28 overlays the adhesive 26 and forms a protective peel-off cover, which when removed exposes the outer surface of adhesive surface 26. The protective backing sheet 28 is removably secured to the card or sheet of material 12 by the adhesive 26. The adhesive 26 and backing sheet 28 may be selected from any type of material known to the art, and adherent materials which serve the equivalent function of an adhesive may be substituted for adhesive 26. For example, coated or sprayed adhesive or glue, sheet adhesive, double sided tape, and the like may be used in the practice of the present invention, and as used herein and in the claims shall al be considered to be "adhesive". Stock self-stick label stock, which includes a sheet base member 12 an adhesive 26, and a backing sheet 28 may be conveniently used to provide the starting elements for use in the production of the design coordinated card of the present invention.

For ease of removal, protective backing material 28 may have an incision, score line, or break 30 which extends across it so as to divide the backing 28 into a first portion 32 and a second portion 34. The incision 30 may be aligned with the line 18 or, in preferred embodiments, as illustrated in the figures, offset from, but parallel to medial line 18. In the preferred form, in which incision 30 is substantially parallel to and offset from line 18, first portion 32 extends past fold line 18. Incision 30 enables backing sheet 28 to be easily peeled away from the adhesive 26 in two separate portions, 32 and 34, and for reasons detailed below, at two different times.

In fulfillment of several of the objects of the present invention, it is desired to provide a design coordinated card which is decorated with a color or a pattern which is coordinated with any item, container, or wrapping paper with which an item or a container may be covered. In the figures, and as detailed below, the design coordinated card is shown to be matched with a gift wrap coveting a container in the form of a box, and the present invention is designed to provide such a card. Referring now to FIGS. 3–10, the present invention accomplishes this object by first providing a decorative wrapping paper 40 which is of a size sufficient to wrap package 44. A portion of wrapping paper 40 at least as large or larger than the first portion 32 of the backing sheet 28 is either removed or preserved from wrapping paper 40, or in the alternative, another piece of paper, not shown, of contrasting, complimentary color or design may be provided.

Figure 4:
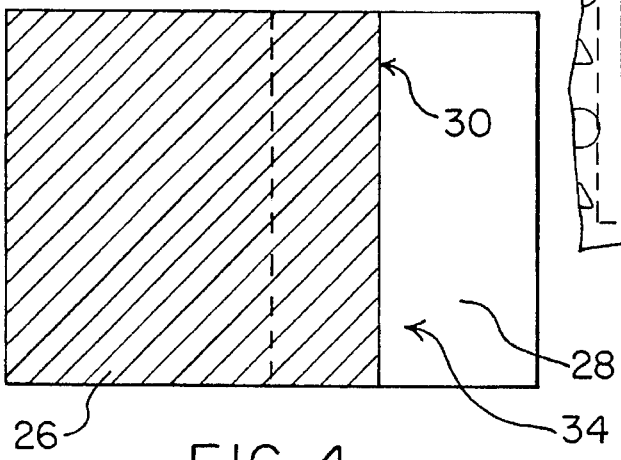
FIG. 4 is a plan view similar to that of FIG. 1 but having the first portion of backing sheet removed therefrom.
Figure 5:
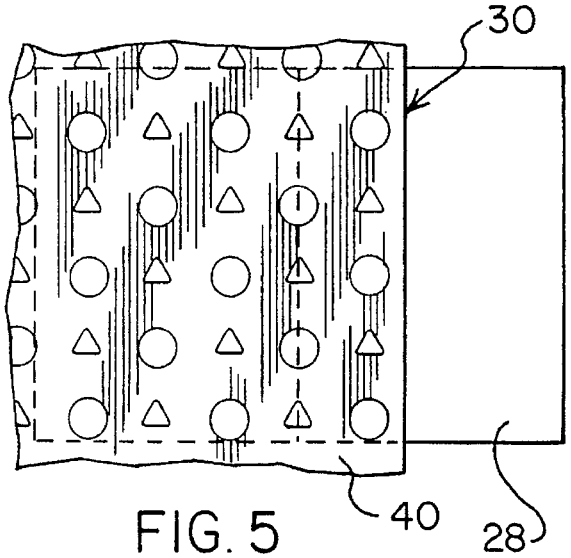
FIG. 5 is a plan view illustrating the piece of decorative wrap of FIG. 3 overlaying a portion of the card illustrated in FIG. 4, and as detailed below.
Figure 6:
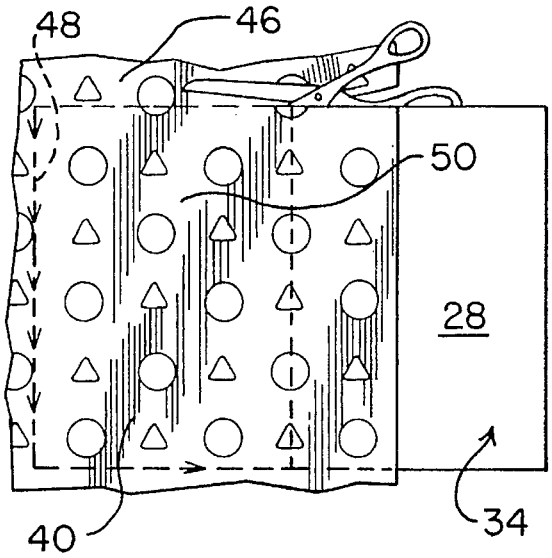
FIG. 6 is a view similar to that of FIG. 5 but illustrating the step of trimming excess decorative wrap material from around the sheet base card.

In the practice of the method of the present invention, first portion 32 of backing sheet 28 is then removed so as to expose the subjacent portion of adhesive 26, as illustrated in FIG. 4. Once the adhesive 26 is exposed at the portion 32, the design coordinated piece of paper 40 is oriented, as necessary and overlaid upon exposed adhesive 26 as illustrated in FIG. 5. Pressure is applied to the paper 40 so as to securely adhere it to the exposed adhesive 26, and thereby to sheet base member 12. As illustrated in FIG. 6, any excess portion 46 of the decorative material 40 is then removed, for example by cutting it with a scissor or a razor along cutting line 48 so that the remaining piece of decorative material 50 is substantially the same size and shape as the portion of sheet base member 12 and adhesive 26 which have been exposed by the removal of the first portion 32 of backing sheet 28.

Figure 8:
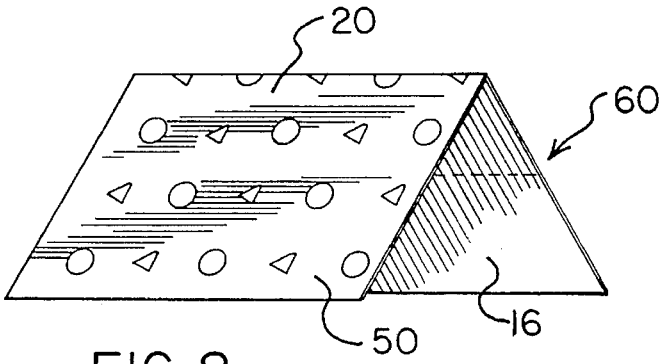
FIG. 8 is a perspective frontal view of the trimmed and folded card constructed in accordance with the present invention, and ready for attachment to a design coordinated item.
Figure 9:
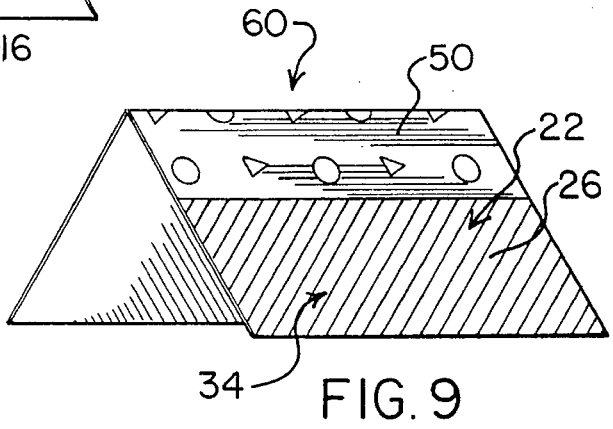
FIG. 9 is a perspective of a rear view of the card illustrated in FIG. 8.
Figure 10:
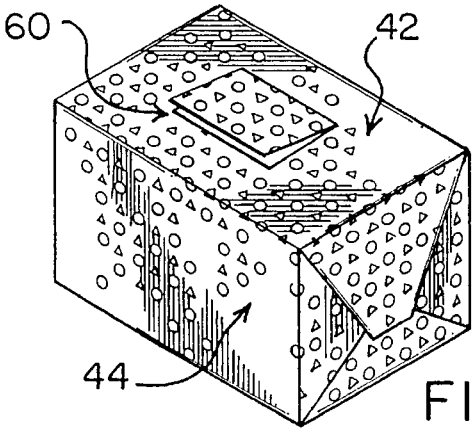
FIG. 10 is a perspective illustration of a wrapped package bearing the design coordinated card of the present invention.

Once the outer surface 14 of the card member 12 has been decorated with the design coordinated material 50, as illustrated by the FIGS. 3–6, and as detailed above, the card member 12 is then folded along line 18 so that the inner surface 16 of the first and second sections 20, 22 are facing each other, and thereby providing the inner surface of a traditional "gift" card. Once such folding has been accomplished along the direction 24 as illustrated in FIG. 7, the final card 60 is formed as illustrated in FIG. 8. As seen from FIG. 8 and FIG. 9, the inner surface 16 may be blank and available for writing appropriate notations thereon, or may be pre-printed with an appropriate message, while the outer surface of the first section 20, past fold line 18, is covered by design coordinated material 50. In preferred embodiments the outer adhesive surface 26 of the second section 22 is not completely covered or blocked by material 50. The remaining portion of the second section 22 may in fact be correlated with the second portion 34 of the backing material 28. As a result, when it is desired to secure the card 60 to the package 44 covered by wrapping paper 42, the second portion 34 of the backing sheet 28 can be removed so as to expose a portion of continuous and discrete adhesive material 26 thereunder. Adhesive material 26 may then be utilized to attach card 60 to gift 44 thereby providing a self adhering card which is coordinated with the paper 42 utilized to wrap the gift 44. In the alternative, the card may be secured to package 44 by other securing means, such as tape, stapling, or the like. Also, only a portion of section 20, or the entire outer surface of sheet base member 12 may be covered with coordinated material 50.

As one embodiment of the present invention, a kit including one or more sheet base member 12, pre-coated with adhesive 26, and having a backing sheet 28 may be packaged with coordinated material 50. In preferred embodiments of such a kit, both wrapping paper 0, and coordinated material 50 will be supplied, and sheet base member 12 will carry a fold line 14, and backing sheet 28 will be scored for ease of removal at a position offset from fold line 18.

As can be seen from the above, the present invention provides a coordinated card for use in coordination with gift wrapping paper, although it is understood that such cards 60 may be used with any item, container, or wrapping paper with which an item or a container may be covered. The card can be covered with the identical paper utilized to wrap a package, or it may be covered with material which is of contrasting, or complimentary color or design. As can be seen from the above, the choice of decorative paper useful with the card 60 of the present invention is varied as the choice of paper variable, and the color and design schemes are as broad as the imagination will permit. As a result of the present invention, it is possible to provide a limitless selection of coordinated cards 60 for use in conjunction with any item, container, or wrapping paper with which an item or a container may be covered, and especially with gift wrapping paper. In this manner, the card can be personalized to suit the taste of the receiver and/or person giving the gift. While the foregoing description has referred to "decorative paper" for use in producing cards 60, it will be understood that this term encompasses virtually any sheet material, including, but not limited to paper plastic, foil, cloth, and the like.

The foregoing exemplary descriptions and the illustrative preferred embodiments of the present invention have been shown in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

The embodiments of the invention in which an exclusive property or privilege is claimed are defined as follows:

1. A custom card for use in design coordination with any specific item, container, or wrapping material, said custom card comprising:

base material in the form of a sheet, said sheet having a body which carries an outer surface and an inner surface, said inner surface including a written or writable portion, and wherein said base material further includes a single fold line to form said base material into first and second inner surface sections and into first and second outer surface sections, said fold line adapted to allow said first and second inner surface sections of said base material to be folded together about said fold line in a manner which allows said written or writable portion of said inner surface to remain accessible;

adherent means distributed over and attached to at least a portion of both said first and second outer surface sections of said body of said base material; and decorative sheet material selected to be design coordinated with any specific item, container, or wrapping material, said decorative sheet material sized to overlay at least said first outer surface section of said base material and a contiguous portion of said second outer surface section of said base material of said adherent means attached to said outer surface of said body of said base material, said decorative sheet material being secured to said portion of said outer surface of said base material by said adherent means, and having at least a portion of said second outer surface section of said base material not covered with said decorative sheet material, wherein said portion of said adherent means distributed over said second outer surface section which is not covered with said decorative sheet material is available for use in securing said custom card flatwise to any specific item, container, or wrapping material.

2. The custom card of claim 1, wherein said portion of said adherent means which is not covered with said decorative sheet material is substantially continuous and discrete.

3. The custom card of claim 2, including a removable backing sheet, wherein said portion of said adherent means which is not covered with said decorative sheet material is substantially continuous and discrete, and is covered with said removable backing sheet, whereby when said removable backing sheet is removed from said substantially continuous and discrete adherent means said substantially continuous and discrete adherent means becomes available for use in securing said custom card to any specific item, container, or wrapping material.

4. The card of claim 3, wherein said backing sheet is sized dimensionally smaller than said second outer section.

5. The card of claim 3, wherein said interface between said decorative sheet material and said adherent means on said second outer section is substantially parallel to said fold line.

6. The card of claim 1, wherein said body of said sheet base material is substantially rectangular.

7. The card of claim 6, wherein said fold line is aligned transversely to the longitudinal axis of said rectangular sheet of said base material.

8. The card of claim 7, wherein said first and second body sections are of substantially equal dimensions.

9. The card of claim 1, wherein said adherent means is comprised of an adhesive.

10. The card of claim 9, wherein said adhesive removably secures said backing sheet material to said outer surface of said sheet base material, and which said adhesive is adapted for attachment of said backing sheet, and which can secure said decorative sheet material when a portion of said backing sheet is removed from said outer surface of said sheet base material.

11. The custom card of claim 1 wherein said decorative sheet material sized to overlay both said first outer surface section of said base material and a contiguous portion of said second outer surface section of said base material of said adherent means attached to said outer surface of said body of said base material.

12. A custom card for use in design coordination with any specific item, container, or wrapping material, said custom card comprising:

base material in the form of a sheet, said sheet having a body which carries an outer surface and an inner surface, said inner surface including an accessible written or writable portion, said base material carrying one and only one fold line to form said base material into first and second inner surface sections and into first and second outer surface sections, said fold line adapted to allow said first and second inner surface sections of said base material to be releasably folded together about said fold line in a manner which allows said written or writable portion of said inner surface to remain accessible;

adherent means attached to at least a portion of both said first and second outer surface sections of said body of said base material, while both said first and second inner surface sections of said body of said base material are substantially free of adherent means; and decorative sheet material which is selected to be design coordinated with any specific item, container, or wrapping material, said decorative sheet material sized to cover and being secured to said first outer surface section of said base material and a contiguous portion of said second outer surface section of said base material, while leaving at least a portion of said second outer surface section of said base material not covered with said decorative sheet material exposed and adapted for use in securing said custom card directly and flatwise at any location on any specific item, container, or wrapping material, without a spacer element, and with at least a portion of said decorative sheet material adjacent to any such specific item, container, or wrapping material.

* * * * *